United States Patent [19]

Takegawa

[11] Patent Number: 4,827,990

[45] Date of Patent: May 9, 1989

[54] AUTOMATIC PICKING REGULATING METHOD FOR AIR JET LOOM AND APPARATUS FOR CARRYING OUT THE SAME

[75] Inventor: Yujiro Takegawa, Ishikawa, Japan

[73] Assignee: Tsudakoma Corporation, Kanazawa, Japan

[21] Appl. No.: 104,757

[22] Filed: Oct. 2, 1987

[30] Foreign Application Priority Data

Oct. 4, 1986 [JP] Japan ..... 61-236669

[51] Int. Cl.[4] ..... D03D 47/36

[52] U.S. Cl. ..... 139/435; 139/452

[58] Field of Search ..... 139/435, 452; 364/470

[56] References Cited

U.S. PATENT DOCUMENTS

| | | | |
|---|---|---|---|
| 3,705,608 | 12/1972 | Vermeulen | 139/435 |
| 4,262,707 | 4/1981 | Suzuki | 139/435 |
| 4,446,893 | 5/1984 | Gunneman et al. | 139/435 |
| 4,595,039 | 6/1986 | Tholander | 139/435 |
| 4,658,865 | 4/1987 | Gotoh | 139/435 |
| 4,673,004 | 6/1987 | Rosseel et al. | 139/435 |
| 4,702,285 | 10/1987 | Sugita | 139/452 |

FOREIGN PATENT DOCUMENTS 60-65150 4/1985 Japan .

*Primary Examiner*—Henry S. Jaudon

*Attorney, Agent, or Firm*—Wenderoth, Lind & Ponack

[57] ABSTRACT

An automatic picking regulating method and an apparatus for carrying out the same are applied to controlling the sequential air jetting operation of the auxiliary nozzle groups of an air jet loom. The auxiliary nozzle groups are arranged along a picking path to jet air so as to assist a picked weft yarn in running along the picking path. The respective jet phase angles of the auxiliary nozzle groups are regulated automatically according to the acutal running speed of the picked weft yarn. The acutal running characteristics of the picked weft yarn are determined on the basis of a holding pin retraction phase angle, namely, a weft yarn release phase angle, and an acutal yarn arrival phase angle measured at a position on the yarn arrival side of the air jet loom, and are represented by a graph showing the relationship between the phase angle of the main shaft of the air jet loom and the picking distance.

6 Claims, 6 Drawing Sheets

AUTOMATIC PICKING REGULATING METHOD FOR AIR JET LOOM AND APPARATUS FOR CARRYING OUT THE SAME

BACKGROUND OF THE INVENTION

1. Field of the Invention

The present invention relates generally to an air jet loom and, more particularly, to an automatic picking regulating method for automatically setting and regulating the respective jetting timing of groups of auxiliary nozzles arranged along the picking path of an air jet loom, and an apparatus for carrying out the same.

2. Description of the Prior Art:

Japanese Patent Publication No. 48-31949 (U.S. Pat. No. 3,705,608) discloses an invention relating to a picking means for an air jet loom, in which auxiliary nozzles arranged along the picking path of an air jet loom are activated sequentially with respect to the picking direction in picking a weft yarn by jetting air by a main nozzles. The auxiliary nozzle are activated sequentially in optimum timing to jet air properly into the picking path so as to urge the weft yarn in the picking direction.

Ordinarily, a weft yarn pulled out from a yarn package is measured and stored, for example, by a drum type weft yarn measuring and storing apparatus, wherein the weft yarn stored on the storage drum of the weft yarn measuring and storing apparatus is released from the storage drum in a timed relationship with the picking operation, and then the weft yarn is picked into the picking path by the main nozzle. As the diameter of the yarn package decreases with the repetition of the picking operation, the resistance against pulling out the weft yarn from the yarn package and the resistance against unwinding the weft yarn from the storage drum vary due to the variation of the curling degree of the weft yarn and the resultant variation of the ballooning behavior of the weft yarn. Consequently, the mode of running of the weft yarn along the picking path varies gradually with the progress of the weaving operation.

Japanese Patent Laid-Open Publication No. 54-106664 discloses an invention relating to a picking means for an air jet loom, in which a plurality of auxiliary nozzles are activated sequentially for jetting air to assist the picked weft yarn for running; and the duration of jetting air by the auxiliary nozzles is extended gradually to cope with the variation of the running mode of the weft yarn with the progress of the picking operation. This means, however, entails the useless consumption of compressed air, and disturbs the air current in the picking path by air jetted by the auxiliary nozzles during an unnecessary period, which makes a stable picking operation impossible.

The jet start timing and jet end timing of each group of auxiliary nozzles are determined experimentally by finding the phase angle of the main shaft of the loom corresponding to the moment of arrival of the free end of a weft yarn picked by the main nozzle at the first auxiliary nozzle of the group through the stroboscopic observation of the picked weft yarn and taking the response speed of the picking fluid control valve into account. However, the observation of the free end of the running weft yarn through intervals between the warp yarns is difficult and requires much time, and the accuracy of the result of the observation is unsatisfactory because of variations of the running speed of the picked weft yarn between picking cycles. Furthermore, the recent trend of weaving a variety of fabrics in a small amount on a loom requires frequent changes of the settings of the loom requiring complicated observations for every change of the setting of the loom, which makes optimum jet timing of the auxiliary nozzles difficult. The optimum jet timing of the auxiliary nozzles is important for saving energy as well as for the stable operation of the loom.

U.S. Pat. No. 4,595,039 discloses an invention relating to means for sequentially controlling the jet condition of groups of auxiliary nozzles on the basis of the actual running speed of a picked weft yarn. According to this known invention, the running speed of the picked weft yarn is measured at a position on the arriving side on an assumption that the picked weft yarn runs along a straight path. Therefore, such a means is effective only when the picked weft yarn runs straight through the shed of the warp yarn; however, the picked weft yarn runs rarely along a straight path in an actual weaving operation.

SUMMARY OF THE INVENTION

Accordingly, it is an object of the present invention to enable both the automatic timing of the jetting operation of each group of auxiliary nozzles and the automatic setting of the duration of the jetting operation of each group of auxiliary nozzles according to the actual running mode of a picked weft yarn, and to enable the accurate regulation of the auxiliary nozzles.

According to the present invention, the jet start timing and jet end timing of each group of auxiliary nozzles are determined, namely, the jetting duration of each group of auxiliary nozzles is set, automatically and each group of auxiliary nozzles is regulated according to the running characteristics of picked weft yarns determined on the basis of the actual moment of arrival of the picked weft yarn measured at the arriving position and the weft yarn releasing timing of the holding pin of the weft yarn measuring and storing apparatus.

The running characteristics of the weft yarn are determined on the basis of the phase angle of the main shaft of the loom and the relationship between a starting position corresponding to the extremity of the main nozzle and the arriving position. The distance of travel of the picked weft yarn is proportional to the phase angle of the loom and hence the relationship between the phase angle of the loom and the distance of travel of the picked weft yarn is represented by a straight line if the picked weft yarn runs at a constant speed. Since the running speed of the picked weft yarn increases with the progress of a weaving operation, the gradient of the straight line increases with the progress of a weaving operation.

When the difference of the actual running characteristics of the picked weft yarn thus determined from the running characteristics determined in the preceding picking cycle is within an allowable range of variation, for example, when the difference of the moment of arrival of the picked weft yarn at the arriving position corresponding to the position of a yarn detector from a predetermined moment is within a predetermined range of variation, the respective jet timings of the groups of auxiliary nozzles are not changed. However, when the difference of the moment of arrival of the picked weft yarn at the arriving position from the predetermined moment is outside the predetermined range of variation, the picked weft yarn is subjected to the current of air jetted by the auxiliary nozzles in the picking path for an inappropriate period of time. Accordingly, the jet timing is readjusted to compensate for the variation of the running mode of the picked weft yarn when the difference is outside the predetermined range of variation. The actual running characteristics may be applied to the next picking cycle without undergoing the decision process.

The total jet period of each group of auxiliary nozzles is divided into a prejet period before the arrival of the picked weft yarn at the group, a main jet period for substantial weft yarn urging action, and a postjet period for assisting the weft yarn in running after the passage of the free end of the weft yarn through the group of auxiliary nozzles. The prejet period and the postjet period are determined in accordance with the type of the weft yarn and are not varied even if the running mode of the same weft yarn varies.

In a representative aspect of the present invention, a prejet end time and a postjet start time are determined on the basis of the actual running characteristics and the disposition of each group of auxiliary nozzles and hence the total jet period is dependent on the prejet period and the postjet period. Consequently, the total jet period is adjusted automatically to an optimum period and in an ideal timing.

In another aspect of the present invention, the jet time and the total jet period are determined by a simple method.

A series of these setting procedures are carried out through a program control process by utilizing the data storing, operating and control functions of a computer as well as through special electrical means.

In the conventional control method of this kind, the pressure of a picking fluid to be jetted by the auxiliary nozzles of each group is the objective controlled variable to make the free end of the picked weft yarn arrive at a predetermined arriving position at a fixed phase angle of the loom. According to the present invention, the jet time of each group of auxiliary nozzles is set and regulated automatically according to the actual running mode of the picked weft yarn to an ideal running mode.

Accordingly, the present invention omits the manual setting operation for timing the jet time. Since the picking operation is regulated properly according to the actual running mode of the picked weft yarn, stable picking operation is achieved without fail and useless consumption of compressed air is prevented.

DESCRIPTION OF THE PREFERRED EMBODIMENTS

Figure 1:
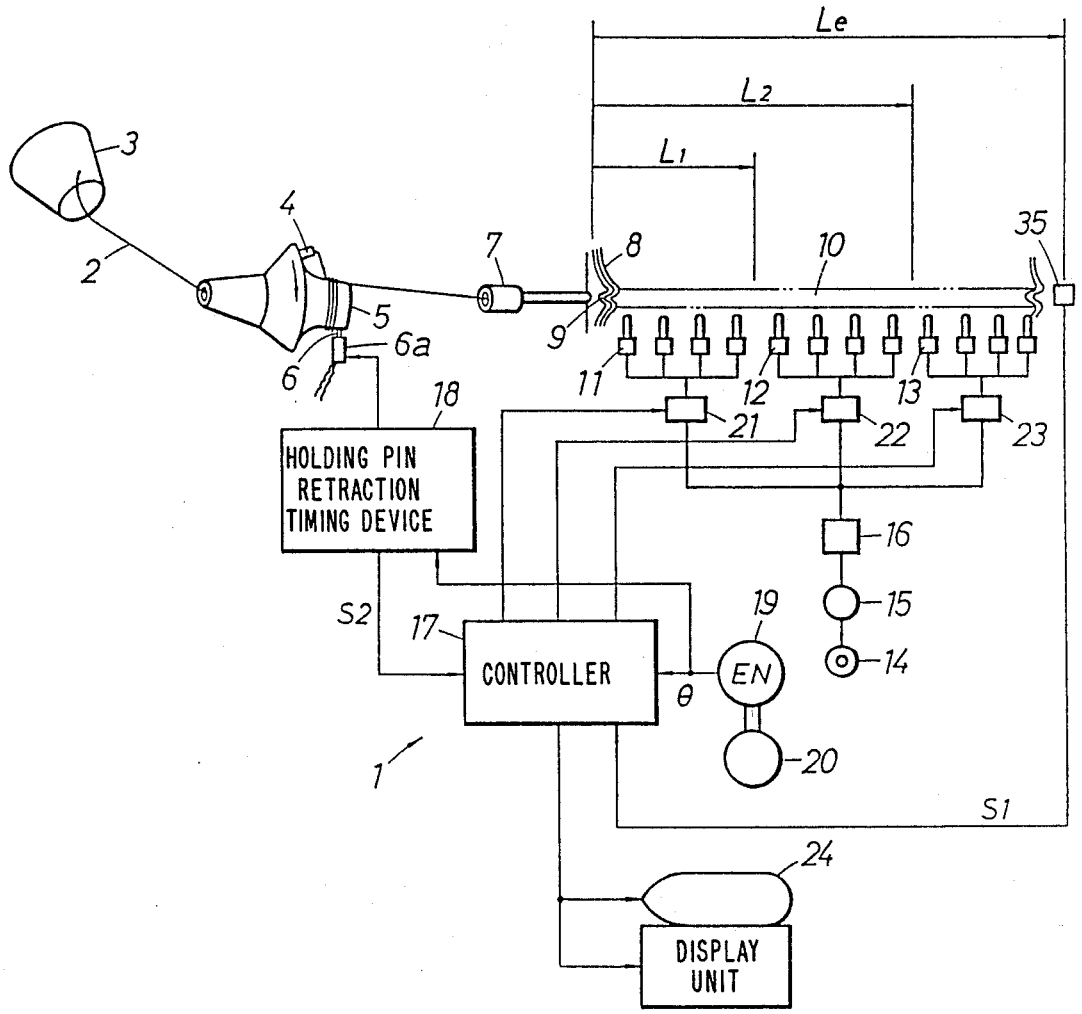
FIG. 1 is a diagrammatic illustration of parts necessary for picking operation.

FIG. 1 shows an automatic picking regulating apparatus 1 according to the present invention in combination with the mechanical components of a picking motion.

A weft yarn 2 pulled out from a yarn package 3 is passed through the rotary yarn guide 4 of a yarn measuring and storing device and is wound around a stationary storage drum 5 by the rotary motion of the rotary yarn guide 4. In winding the weft yarn 2 around the storage drum 5, the holding pin 6 of the yarn measuring and storing device engages the circumference of the storage drum 5 to hold the weft yarn 2 wound on the storage drum 5. In picking the weft yarn 2, the holding pin 6 is retracted from the circumference of the storage drum 5 by an actuator **6*a* to release the weft yarn 2 and, at the same time, the weft yarn is picked along the air guides 9 of the reed by a main nozzle 7**, which has previously started jetting air so as to pick the weft yarn.

While the picked weft yarn 2 is running along the picking path 10, a plurality of auxiliary nozzle groups, for example, three auxiliary nozzle groups, namely, the first group 11, the second group 12 and the third group 13, of auxiliary nozzles are activated sequentially to urge the running weft yarn 2 in the picking direction. The complete insertion of the weft yarn 2 is detected by a yarn arrival detector 35 disposed on the extension of the line of the air guides 9.

The auxiliary nozzle groups 11, 12 and 13 of the auxiliary nozzles are connected through on-off valves 21, 22 and 23, respectively, a regulator 16 and an accumulator 15 to a compressed air source 14. The on-off valves 21, 22 and 23 are controlled by a controller 17, which is the principal component of the automatic picking regulating apparatus 1. A holding pin retraction timing device 18, the yarn arrival detector 35 and a phase angle detector 19 are connected to the input ports of the controller 17, while the on-off valves 21, 22 and 23 and a display unit 24 are connected to the output ports of the controller 17.

Upon the detection of the free end of the picked weft yarn 2 at an arrival position, the yarn arrival detector 35 generates and applies a yarn arrival signal S1 to the controller 17 of the automatic picking regulating apparatus 1. The phase angle detector 19 is connected to the main shaft 20 of the loom. The phase angle detector 19 connected to the main shaft of the loom generates and applies a phase signal representing a phase angle 8 of the main shaft 20 in one weaving cycle of the loom to the controller 17 of the automatic picking regulating apparatus 1. The holding pin retraction timing device 18 is set for a timing of the retracting of the holding pin 6, namely, a timing for releasing the weft yarn 2. The phase angle detector 19 is connected to the input port of the holding pin retraction timing device 18.

During the weaving operation of the loom, the phase angle detector 19 outputs phase signals respectively representing the phase angles of the main shaft of the loom to the holding pin retraction timing device 18. The holding pin retraction timing device 18 gives a weft yarn releasing signal S2 to the actuator **6*a* for retracting the holding pin 6 and to the controller 17** at a time corresponding to a set weft yarn releasing phase angle.

Figure 2:
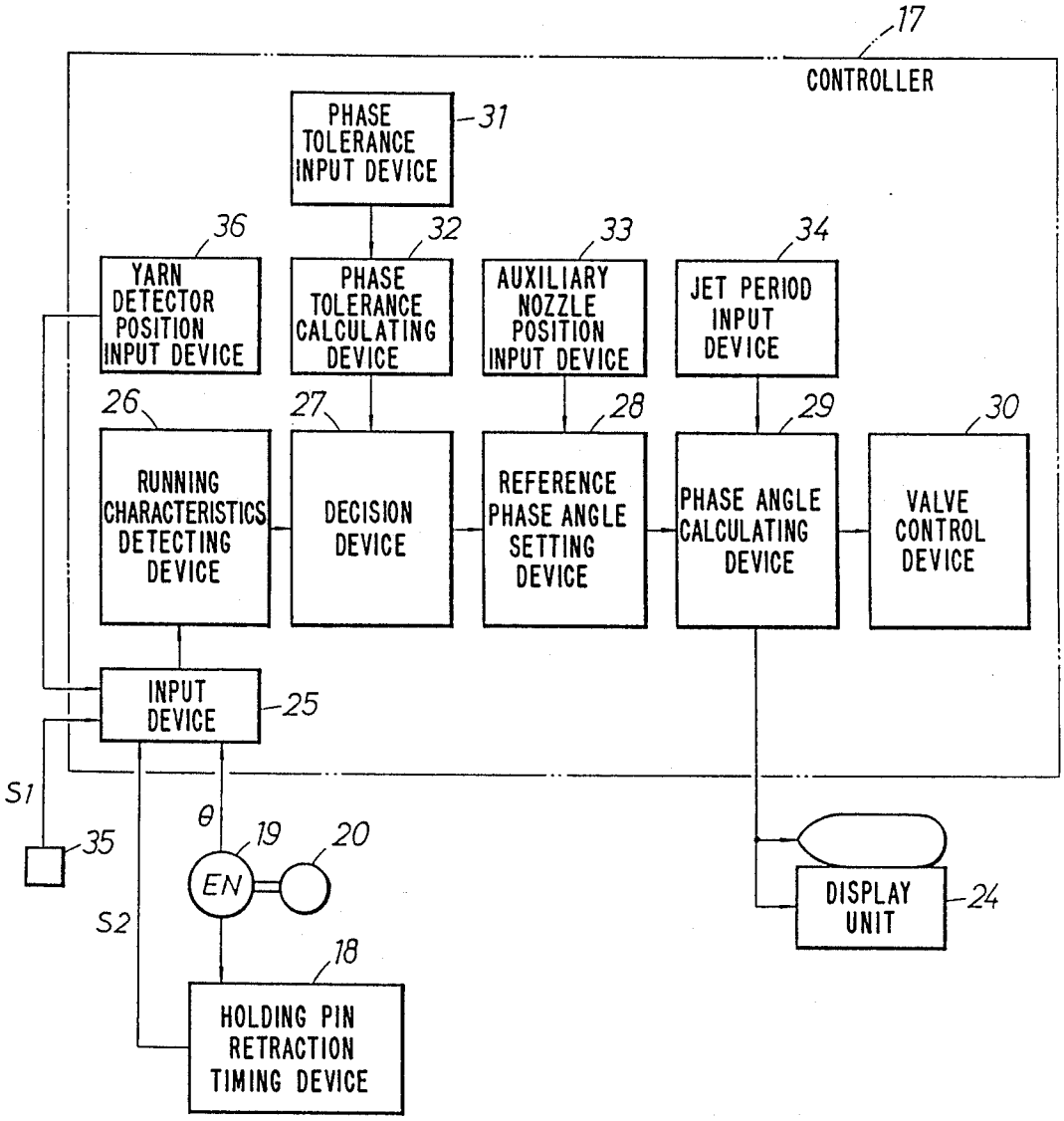
FIG. 2 is a block diagram of an automatic picking regulating apparatus, in a preferred embodiment, according to the present invention.

Referring to FIG. 2 showing the construction of the controller 17, the holding pin retraction timing device 18, a yarn detector position input device 36, the yarn arrival detector 35 and the phase angle detector 19 are connected through an input device 25 to a running characteristics detecting device 26. The running characteristics detecting device 26, a decision device 27, a reference phase angle setting device 28, a phase angle calculating device 29 and a valve control device 30 are interconnected sequentially in that order. A phase tolerance input device 31 is connected through a phase tolerance calculating device 32 to the input of the decision device 27. An auxiliary nozzle position input device 33 is connected to the reference phase angle setting device 28. A jet period input device 34 and the display unit 24 are connected to the input and output, respectively, of the phase angle calculating device 29. These essential components of the automatic picking regulating apparatus 1 operate sequentially according to a control program. The running characteristics detecting device 26, the decision device 27, the reference phase angle setting device 28 and the phase angle calculating device 29 are included in a microcomputer.

The manner of operation of the automatic picking regulating apparatus 1 of the present invention thus constructed will be described hereinafter.

When a yarn 2 releasing signal S is output at a moment corresponding to a phase angle 80 set by the holding pin retraction timing device 18, the holding pin 6 is retracted so as to release the weft yarn 2, and so that the weft yarn 2 is picked by the main nozzle 7 along the picking path 10. The complete insertion of the weft yarn 2 is detected by the yarn arrival detector 35. The picking operation is controlled in timed relationship with the phase angle $\theta$ of the main shaft 20 of the loom. At the start of the loom, the respective air jet periods of the auxiliary nozzle groups 11, 12 and 13 of the auxiliary nozzles are set in proper sequence.

Figure 3:
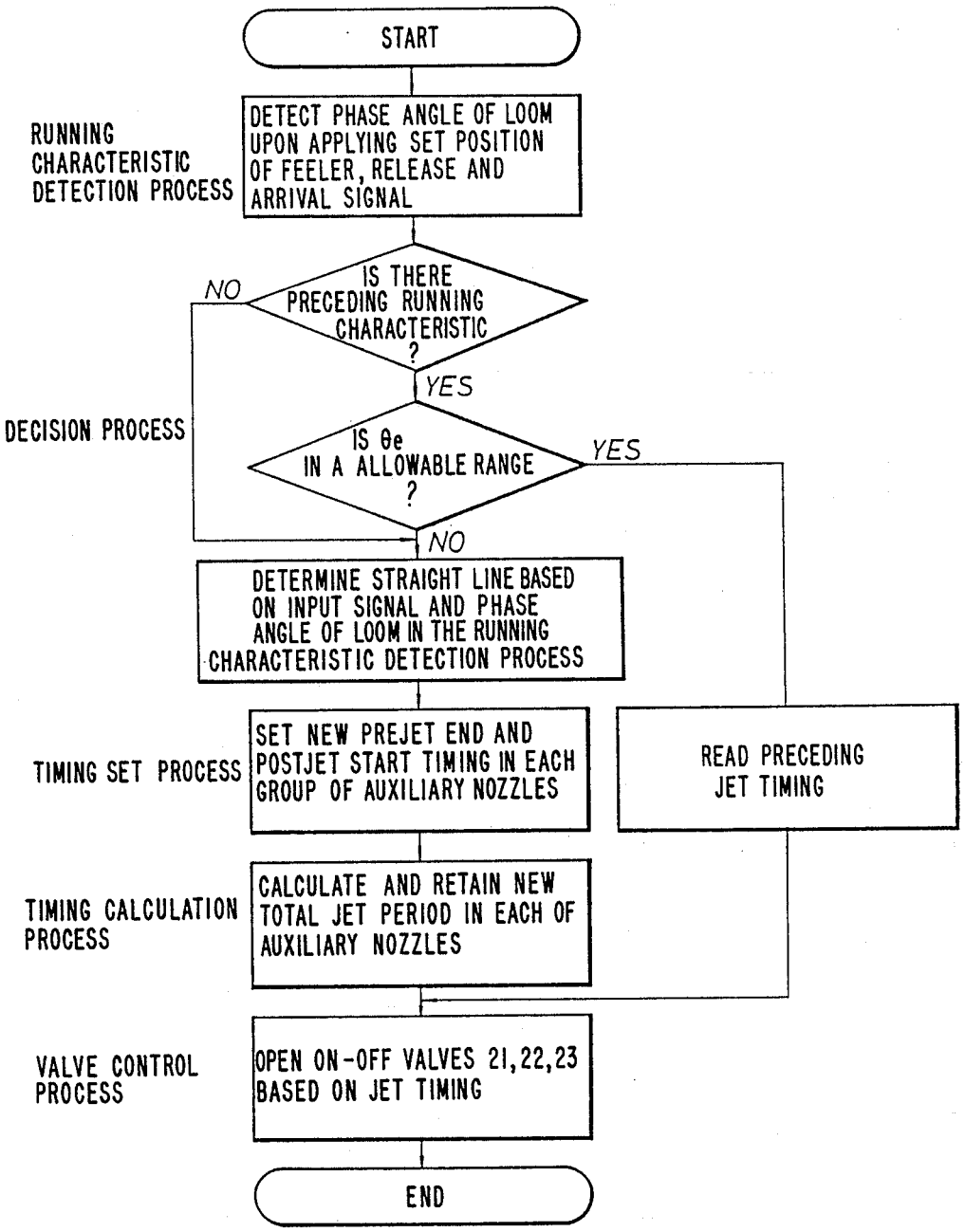
FIG. 3 is a flow chart of a control program to be executed by the automatic picking regulating apparatus of FIG. 2.

The automatic picking regulating apparatus 1 executes a control program shown in FIG. 3 periodically during the weaving operation.

Figure 4:
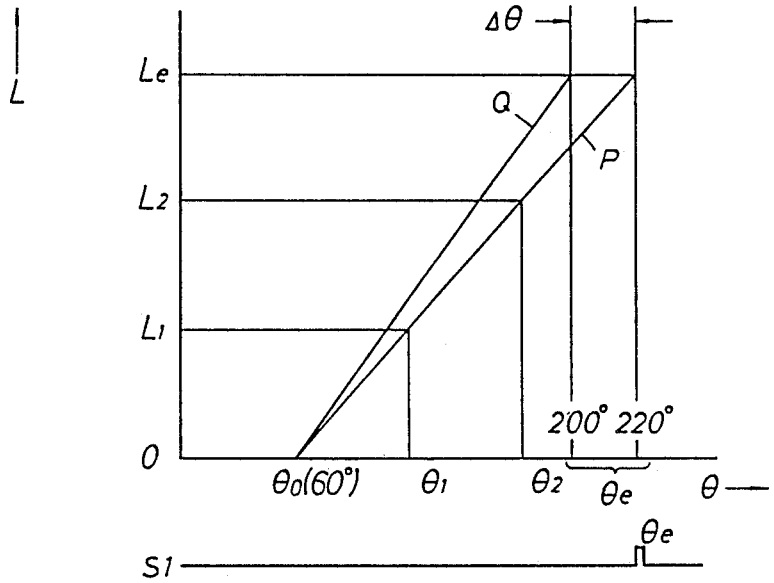
FIG. 4 is a graph showing the running characteristics of a picked weft yarn.

First, the running characteristics detecting device 26 receives a weft yarn release signal S2 from the holding pin retraction timing device 18, a yarn arrival signal S1 from the yarn arrival detector 35, the distance Le between the extremity of the main nozzle 7 and the yarn arrival detector 35, and a signal representing the phase angle 8 of the main shaft 20 from the phase angle detector 19 after the loom has been started to determine the relationship between the actual distance of travel L of the picked weft yarn 2 and the phase angle $\theta$ of the main shaft 20 of the loom as shown in FIG. 4. The picked weft yarn 2 runs through a distance Le between the extremity of the main nozzle 7 and the yarn arrival detector 35 at a constant running speed from a moment when the weft yarn is released to a moment when the yarn arrival detection signal S1 is provided.

When the moment when the holding pin 6 is retracted to release the weft yarn 2 wound on the storage drum 5, namely, a yarn release phase angle $\theta_0$, is fixed, for example, at 60°, the moment of completion of the insertion of the weft yarn 2, namely, a yarn arrival phase angle $\theta_e$ is, for example, 220° while the diameter of the yarn package 3 is large. Since a decrease in diameter of the yarn package 3 with the progress of the weaving operation causes changes in resistance to pulling out the weft yarn 2 from the yarn package 3, the tension of the weft yarn 2 in winding the weft yarn 2 on the storage drum 5 or resistance in unwinding the weft yarn 2 from the storage drum, the yarn arrival phase advances gradually, namely, the yarn arrival phase angle $\frac{1}{4}e$ decreases gradually, for example, to a phase angle on the order of 200°. Consequently, the running characteristics varies with time from a straight line P representing the initial running characteristics, namely, running characteristics when the diameter of the yarn package 3 is large, to a straight line Q representing the final running characteristics, namely, the running characteristics when the diameter of the yarn package 3 is small. The gradient of the straight line Q is greater than that of the straight line P. The gradient of the straight line corresponds to the running speed V of the weft yarn 2. In FIG. 4, L1, L2 and Le are distances from the extremity of the main nozzle 7 to the respective first auxiliary nozzles of the auxiliary nozzle groups 11 and 12 and the yarn arrival detector 35, respectively, and the extremity of the main nozzle 7 is the start position of the picking path 10. Phase angles $\theta_1$, $\theta_2$ and $\theta_e$ for the straight line P corresponds to the respective moments of passage of the free end of the weft yarn 2 by positions at distances L1, L2 and Le from the extremity of the main nozzle 7.

Thus, the moment of arrival of the weft yarn 2 at the arriving position, namely, the arrival phase angle $\theta_e$, varies by a phase angle difference $\Delta\theta$ between a state where the yarn package 3 is full and a state where the same yarn package 3 is depleted.

Figure 5:
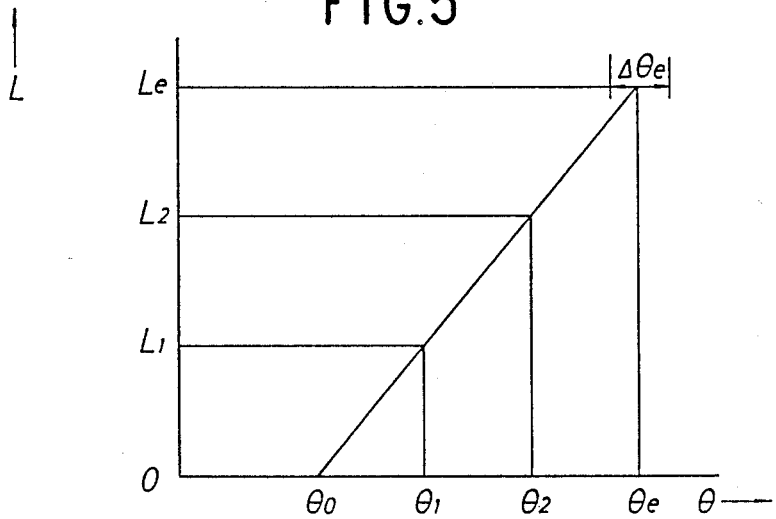
FIG. 5 is a graph showing an allowable range.

Secondly, a decision is made whether the running characteristics determined in the preceding picking cycle are available. In the first picking cycle, no preceding data representing the running characteristics are available and the control operation is carried out on the basis of predetermined standard initial data, and hence a step for determining the running characteristics is executed. When running characteristics in the preceding picking cycle is available, the decision device 27 decides whether the actual arrival phase angle $\theta_e$ at the distance Le is within the allowable phase range. The phase tolerance input device 31 gives a phase tolerance to determine an allowable phase range, and the phase tolerance calculating device 32 calculates the allowable phase range beforehand and gives the calculated allowable phase range to one of the inputs of the decision device 27. As shown in FIG. 5 by way of example, a phase angle tolerance $\Delta\theta_e$ at the distance Le from the extremity of the main nozzle 7 is set.

Figure 6:
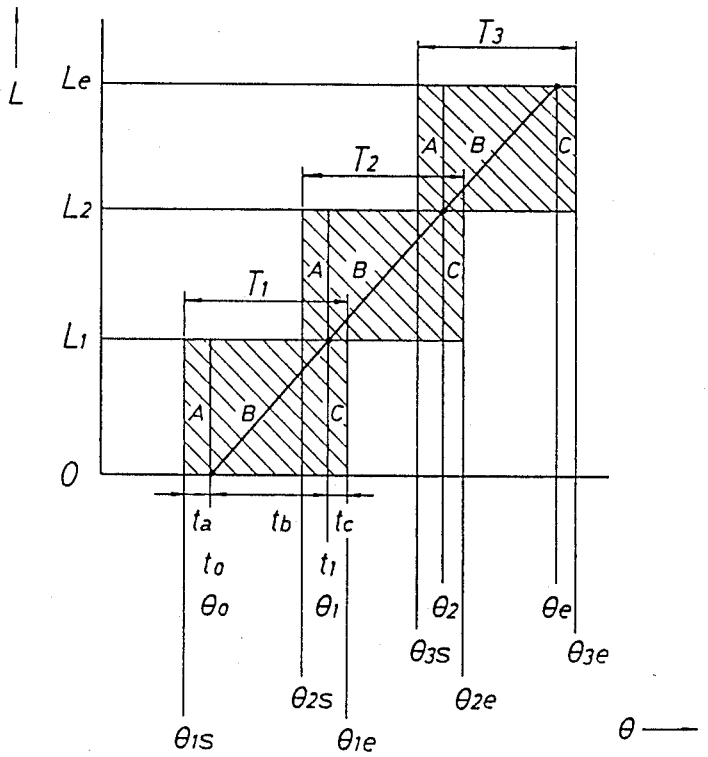
FIG. 6 is a graph showing the relationship between the running characteristics and jet timing for the automatic picking regulating apparatus of FIG. 2.

When the arrival phase angle $\theta_e$ is outside a range defined by the phase angle tolerance $\Delta\theta_e$, the respective jet phase angles of the auxiliary nozzle groups 11, 12 and 13 need be changed. The reference phase angle setting device 28 determines a straight line representing the actual running characteristics, and then determines prejet end phase angles $\theta_0$, $\theta_1$ and $\theta_2$ respectively for the prejet operation A of the auxiliary nozzle groups 11, 12 an 13 of the auxiliary nozzles, and postjet start phase angles $\theta_1$, $\theta_2$, and $\theta_e$ respectively for the postjet operation C of the auxiliary nozzle groups 11, 12 and 13 of the auxiliary nozzles (FIG. 6).

As mentioned above and shown in FIG. 6, the auxiliary nozzle groups 11, 12 and 13 of the auxiliary nozzles are activated sequentially to jet air in the picking direction for different total jet periods $T_1$, $T_2$ and $T_3$ in order to assist the running of the picked weft yarn 2. The phase angles $\theta_1$, $\theta_2$ and $\theta_e$ correspond to the respective first auxiliary nozzles of the auxiliary nozzle groups 11, 12 and 13 and the position of the yarn arrival detector 35 on the straight line representing the running characteristics. Accordingly, the respective positions, for example of the respective first auxiliary nozzles of the auxiliary nozzle groups 11, 12 an 13 are given beforehand to the reference phase angle deciding device 28. The end phase angle $\theta_0$ of the prejet operation A an the start phase angle $\theta_1$ of the postjet operation C for the first auxiliary nozzle group 11, the end phase angle $\theta_1$ of the prejet operation A and the start phase angle $\theta_2$ of the postjet operation C for the second auxiliary nozzle group 12, and the end phase angle $\theta_2$ of the prejet operation A and the start phase angle $\theta_e$ of the postjet operation C for the third auxiliary nozzle group 13 are determined on the basis of the straight line representing the running characteristics.

The phase angle calculating device 29 calculates start phase angles $\theta_{1s}$, $\theta_2$ and $\theta_{3s}$ of the prejet operation A and end phase angles $\theta_{1e}$, $\theta_{2e}$ and $\theta_{3e}$ respectively for the first, second and third auxiliary nozzle groups 11, 12 and 13 on the basis of data input thereto by the reference phase angle setting device 28.

Prejet period $t_a$ and postjet period $t_c$ or the corresponding phase angles of the main shaft 20 of the loom are input beforehand to the phase angle calculating device 29 by the jet period input device 34 for calculating the prejet start phase angles and the postjet end phase angles. The phase angle calculating device 29 calculates and holds the prejet start phase angle $\theta_{1s}$ advanced by a phase angle corresponding to the prejet period $t_a$ from the prejet end phase angle $\theta_0$, and the postjet end phase angle $\theta_{1e}$ is delayed by a phase angle corresponding to the postjet period $t_c$ from the postjet start phase angle $\theta_1$ to determine the total jet period $T_1$ for the first auxiliary nozzle group 11. Total jet periods $T_2$ and $T_3$ respectively for the second and third auxiliary nozzle groups 12 and 13 are determined in a similar manner. Consequently, the main jet period $t_b$ of the main jet operation B is determined automatically.

The total jet periods $T_1$, $T_2$ and $T_3$ defined by the phase angles $\theta_{1s}$, $\theta_{2s}$, $\theta_{3s}$, $\theta_{1e}$ and $\theta_{3e}$ for the auxiliary nozzle groups 11, 12 and 13 are inputs to the valve control device 30. The valve control device 30 opens the on-off valves 21, 22 and 23 sequentially for the total jet periods $T_1$, $T_2$, and $T_3$, respectively so that the total jet periods $T_1$, $T_2$ and $T_3$ overlap each other as shown in FIG. 6 to generate a continuous auxiliary air current in the picking path 10. The auxiliary air current assists the picked weft yarn 2 for stable running.

In the decision step, the jet phase angles need not be changed when the yarn arrival phase angle is within an allowable range defined by the phase angle tolerance $\Delta\theta_e$. Therefore the valve control device 30 reads the total jet periods $T_1$, $T_2$ and $T_3$, for the preceding picking cycle previously stored in the phase angle calculating device 29 and controls the on-off valves 21, 22 and 23 according to the total jet periods $T_1$, $T_2$ and $T_3$, respectively.

When necessary, the straight line representing the running characteristics is converted into image signals and is displayed on the display unit 24 to enable the visual observation of the running characteristics, the jet periods and jet phase angles by the operator.

The foregoing steps of control operation are repeated periodically during the weaving operation of the loom to regulate the jet phase angles of the auxiliary nozzle groups 11, 12 and 13 according to the actual running mode of the picked weft yarn 2.

In the first embodiment described hereinbefore, a decision is made whether the measured yarn arrival phase angle is within the allowable range before determining the running characteristics. However, it is also possible to L decide whether the actual yarn arrival phase angle $\theta_e$ is within the allowable range defined by the phase angle tolerance $\Delta\theta_e$ before determining the running characteristics and, when the actual yarn arrival phase angle is outside the allowable range, to calculate the phase angles of the passage of the free end of the picked weft yarn 2 by the respective first auxiliary nozzles of the auxiliary nozzle groups 11, 12 and 13 in the next step.

Incidentally, although the method carried out in the first embodiment is the most rational one, the total jet periods $T_1$, $T_2$ and $T_3$ can be determined by the following simple method.

Figure 7:
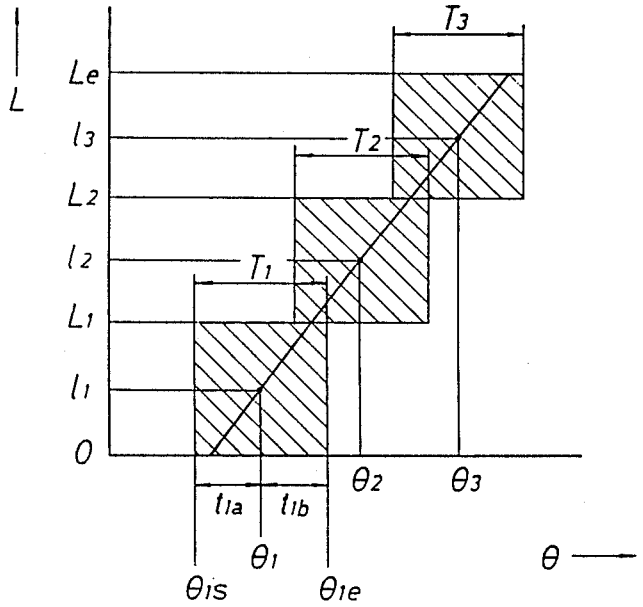
FIGS. 7 and 8 are graphs showing the relationship between the running characteristics and jet timing for automatic picking regulating apparatus, in further embodiments, according to the present invention.

An automatic picking regulating method, in a second embodiment, according to the present invention will be described with reference to FIG. 7. A jet start phase angle $\theta_{1s}$ and a jet end phase angle $\theta_{1e}$ are determined by subtracting a phase angle corresponding to a fixed time t1b from a phase angle $\theta_1$ corresponding to the moment of passage of the free end of the picked weft yarn 2 by the middle auxiliary nozzle of the first auxiliary nozzle group 11 to determine a total jet period $T_1$ for the first auxiliary nozzle group 11. Total jet periods $T_2$ and $T_3$ respectively for the second and third auxiliary nozzle groups 12 and 13 are determined in a similar manner.

Figure 8:
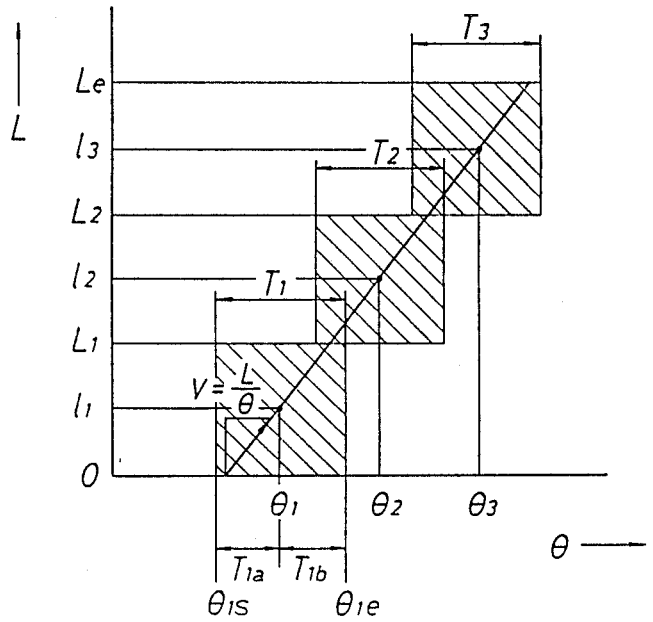

An automatic picking regulating method, in a third embodiment, according to the present invention will be described hereinafter with reference to FIG. 8. In the third embodiment, a total jet period $T_1$ for the first auxiliary nozzle group 11 is determined through calculation by using the expressions $T_{1a}=k1/V$ and $T_{2a}=k2/V$, where k1 and k2 are constants and V is the running speed of the weft yarn 2 corresponding to the gradient of a straight line representing the running characteristics. Total jet periods $T_2$ and $T_3$ for the second an third auxiliary nozzle groups 12 and 13 are determined in a similar manner.

What is claimed is:

1. An automatic picking regulating method for an air jet loom, comprising steps of:

determining actual running characteristics of a picked weft yarn in one picking cycle of the air jet loom on the basis of a holding pin retraction phase angle when the holding pin is retracted, and an actual yarn arrival phase angle detected by a yarn arrival detector located at a predetermined position on the yarn arrival side of the air jet loom;

determining new reference jet start phase angles and new reference jet end phase angles for the jet operation of the auxiliary nozzle groups for the subsequent picking cycle on the basis of the actual running characteristics and the respective positions of the first, second and third auxiliary nozzle groups;

calculating total jet periods for the auxiliary nozzle groups on the basis of the new reference jet start phase angles and the new reference jet end phase angles; and sequentially activating the auxiliary nozzle groups with respect to the picking direction respectively for the total jet periods.

2. An automatic picking regulating method according to claim 1, wherein said total jet periods are determined by subtracting phase angles corresponding to predetermined time periods from and adding phase angles corresponding to predetermined time periods to reference phase angles, respectively, in said step for calculating the phase angles.

3. An automatic picking regulating method according to claim 1, wherein said total jet periods are determined on the basis of values determined by multiplying predetermined constants by the reciprocal of an actual running speed of the picked weft yarn in said step for calculating the phase angle.

4. An automatic picking regulating method for an air jet loom, comprising steps of:

determining actual running characteristics of a picked weft yarn in one picking cycle of the air jet loom on the basis of a holding pin retraction phase angle when the holding pin is retracted, and an actual yarn arrival phase angle detected by a yarn arrival detector located at a predetermined position on the yarn arrival side of the air jet loom;

deciding whether the actual yarn arrival phase angle detected by the yarn arrival detector is within a predetermined range defined by a phase angle tolerance;

determining new reference prejet end phase angles of prejet operation and new reference postjet start phase angles of postjet operation respectively for auxiliary nozzle groups for the subsequent picking cycle on the basis of the actual running characteristics and the respective positions of the auxiliary nozzle groups, when the actual yarn arrival phase angle is outside the predetermined range defined by the phase angle tolerance;

determining jet start phase angles for the respective prejet operation of the auxiliary nozzle groups advanced by phase angles respectively corresponding to prejet periods from the respective jet end phase angles of the prejet operation, and jet end phase angles for the respective postjet operation of the auxiliary nozzle groups delayed by phase angles respectively corresponding to postjet periods from the respective jet start phase angles of the postjet operation; and sequentially activating the auxiliary nozzle groups with respect to the picking direction respectively for the total jet periods.

5. An automatic picking regulating apparatus for an air jet loom, comprising:

a phase angle detector for detecting the phase angle of the main shaft of the air jet loom in one picking cycle;

a holding pin retraction timing device which provides a holding pin retraction signal to retract the holding pin of the air jet loom;

a yarn arrival detector located at a predetermined position on the yarn arrival side of the air jet loom;

a running characteristics detecting device for determining actual running characteristics of a picked weft yarn on the basis of a phase angle, detected by said phase angle detector, the holding pin retraction phase angle set by said holding pin retraction timing device and an actual yarn arrival phase angle detected by said yarn arrival detector;

a decision device which decides whether the actual yarn arrival phase angle detected by said running characteristics detecting device is within an allowable range defined by a phase angle tolerance;

a reference phase angle setting device which sets new prejet end phase angles respectively for the prejet operation of the auxiliary nozzle groups and new postjet start phase angles respectively for the postjet operation of the auxiliary nozzle groups on the basis of the actual running characteristics and the respective positions of the auxiliary nozzle groups, when the actual yarn arrival phase angle is outside the allowable range defined by the phase angle tolerance;

a phase angle calculating device which determines prejet start phase angles respectively for the auxiliary nozzle groups which are advance by phase angles corresponding to predetermined prejet start periods from the prejet end phase angles for the auxiliary nozzle groups, respectively, and post jet end phase angles delayed by phase angles corresponding to predetermined postjet periods from the postjet start phase angles for the auxiliary nozzle groups, respectively; and a valve control device which activates the auxiliary nozzle groups sequentially for total jet periods, respectively, between the prejet start phase angles respectively for the prejet operation of the auxiliary nozzle groups and the postjet end phase angles respectively for the postjet operation of the auxiliary nozzle groups.

6. An automatic picking regulating apparatus according to claim 5, wherein said running characteristics detecting device, said decision device, said reference phase angle setting device and said phase angle calculating device are included in a microcomputer for control operation.

* * * * *